United States Patent [19]

Bright

[11] 4,331,372

[45] May 25, 1982

[54] SUBSTRATE CONNECTOR SYSTEM UTILIZING A CONTACT ACTUATING BAR

[75] Inventor: Edward J. Bright, Elizabethtown, Pa.

[73] Assignee: AMP Incorporated, Harrisburg, Pa.

[21] Appl. No.: 143,215

[22] Filed: Apr. 24, 1980

[51] Int. Cl.[3] ..... H01R 13/629

[52] U.S. Cl. ..... 339/74 R; 339/176 MP

[58] Field of Search ..... 339/75 M, 75 MP, 74 R, 339/198 H, 176 MP; 200/153 LA

[56] References Cited

U.S. PATENT DOCUMENTS

| | | | |
|---|---|---|---|
| 3,199,066 | 8/1965 | Eledge et al. | 339/176 MP |
| 3,426,313 | 2/1969 | Wycheck | 339/74 R |
| 3,430,186 | 2/1969 | Herb et al. | 339/74 |
| 3,670,288 | 6/1972 | Evans | 339/74 R |
| 4,047,789 | 9/1977 | Glaesel | 339/198 H |

*Primary Examiner*—Neil Abrams

*Attorney, Agent, or Firm*—Allan B. Osborne

[57] ABSTRACT

The present invention relates to a connector system adapted to electrically connect an active device substrate to the conductive paths on a printed circuit board. The connectors of the system have means therein to relieve the force exerted by the contained spring contacts so that the forces required to insert and withdraw the substrate is effectively zero. The means include an actuating bar which engages and moves the cantilever beam on the contacts out of engagement.

3 Claims, 10 Drawing Figures

SUBSTRATE CONNECTOR SYSTEM UTILIZING A CONTACT ACTUATING BAR

BACKGROUND OF THE INVENTION

1. The Field of the Invention

The invention relates to devices which mechanically retain and electrically connect ceramic active device substrates to a printed circuit board. The ceramic substrate is of the type having a single row of contact pads along one edge on the cover side.

2. The Prior Art

There are many kinds of connectors having means so that a PCB or substrate can be inserted without the application of force. The means universally are such as to temporarily move the contact spring members out of the way while the board or substrate is being loaded into the connector. One such connector is disclosed in U.S. Pat. No. 3,899,234.

It is a card-edge connector having a cam which, upon rotating, moves the contact members out of the PCB-receiving slot. U.S. Pat. No. 4,080,032 employs a longitudinally moving draw bar to transversely move actuating members to which are hooked the inside arms of double arm contact spring members. While the inside arm is pulled inwardly the legs on a DIP are freely inserted into or removed from the connector.

SUMMARY OF THE PRESENT INVENTION

The present invention discloses both an individual connector adapted to receive and connect circuits on one side of a ceramic substrate, and a system composed of a number of individual connectors and a support plate. The connector contains a plurality of spring members having contact-carrying cantilever beams. An actuating bar, moved by a screwdriver tip or the like, has a plurality of bosses which engage the beams. Upon moving the bar, the beams are moved laterally out of the substrate-receiving pocket and the substrate may be inserted or removed without interference from the contacts.

DESCRIPTION OF THE PREFERRED EMBODIMENT

Figure 1:
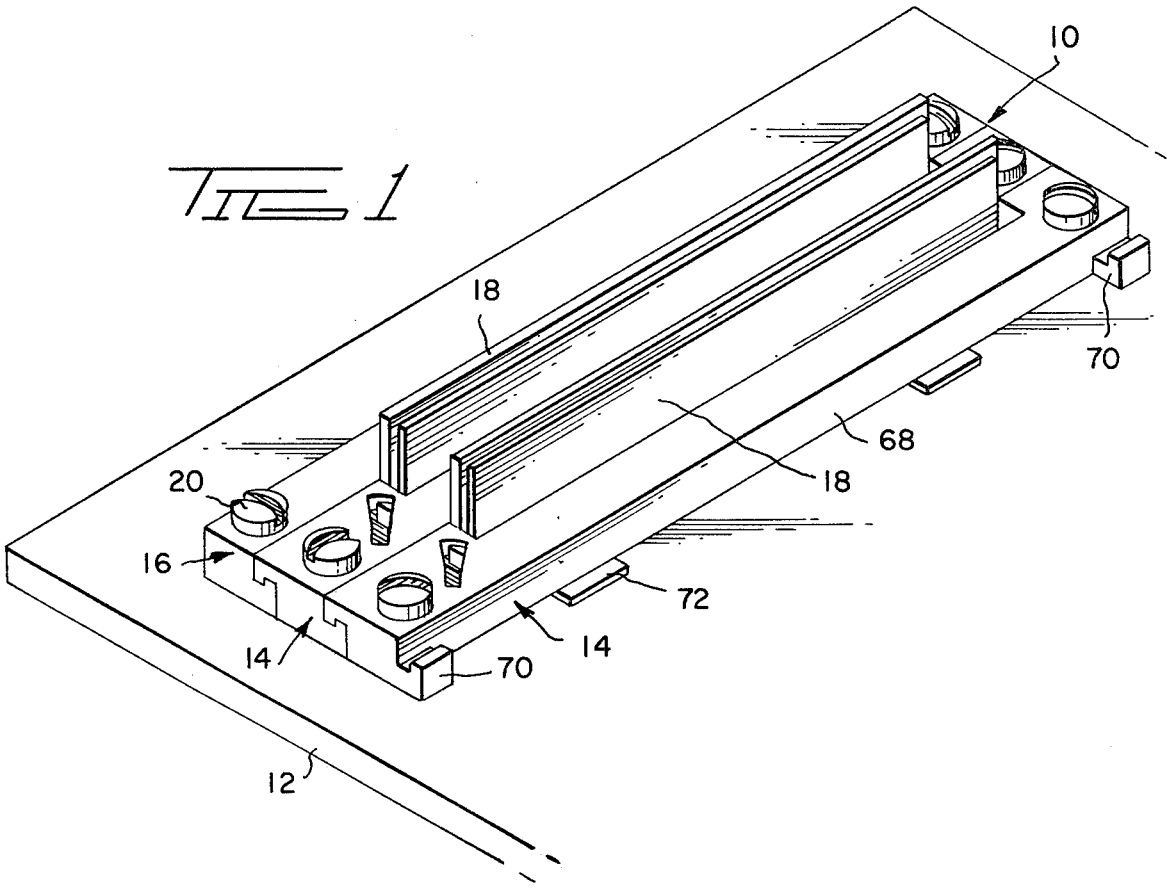
FIG. 1 is a perspective view of the connector system of the present invention mounted on a PCB.

FIG. 1 illustrates substrate connector system 10 mounted on a PCB (printed circuit board) 12. Two individual connectors 14 are shown along with support plate 16. Two substrates 18 are loaded into the system.

Conventional screws 20 are used to mechanically fasten the system to the board.

Figure 2:
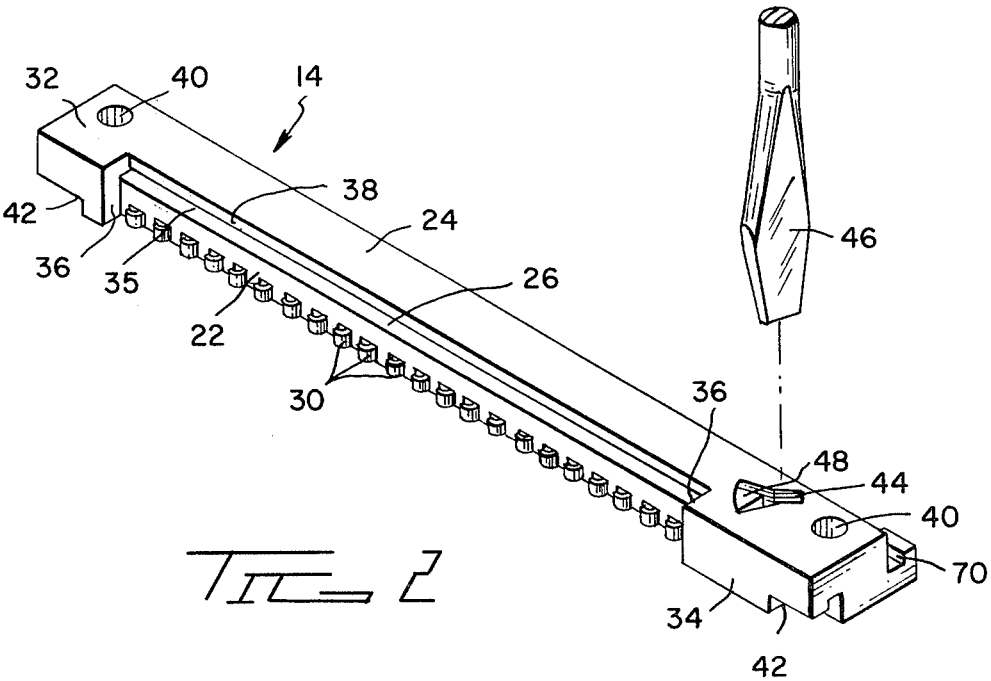
FIG. 2 is a perspective view of an individual connector of FIG. 1.
Figure 5:
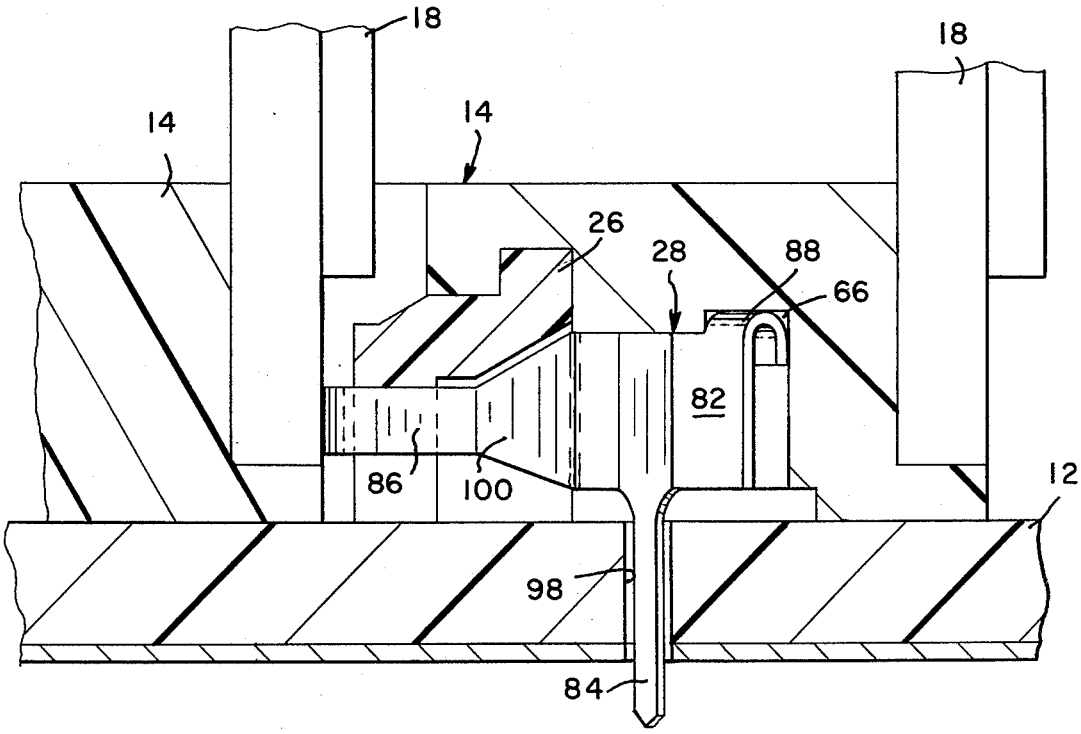
FIG. 5 illustrates the spring member used in the connector of the present invention.

FIG. 2 illustrates an individual connector 14 looking into what may be considered its front face, indicated generally by reference numeral 22. The connector has three components: housing 24, actuating bar 26 and spring members 28 of which only the contact ends 30 can be seen protruding through the actuating bar. FIG. 5 shows a side view of a spring member 28.

Housing 24 is preferably molded, using as a material glass-filled polyester. The front face is recessed between the housing's left end 32 and right end 34. Defining the recess, indicated generally by reference numeral 35, are two facing walls 36 and front wall 38.

Both ends, 32 and 34 have mounting holes 40 to receive therethrough the screws shown in FIG. 1. Further each outside, forward corner has been notched as indicated by reference numeral 42. The notch is L-shaped as viewed from an end.

The right end, reference numeral 34, further includes slot 44 opening out on its upper surface. The slot is wide at one end to allow tip 46 of a screwdriver to pivot and move actuating bar 26, end 48 of which can be seen in the slot.

Figure 3A:
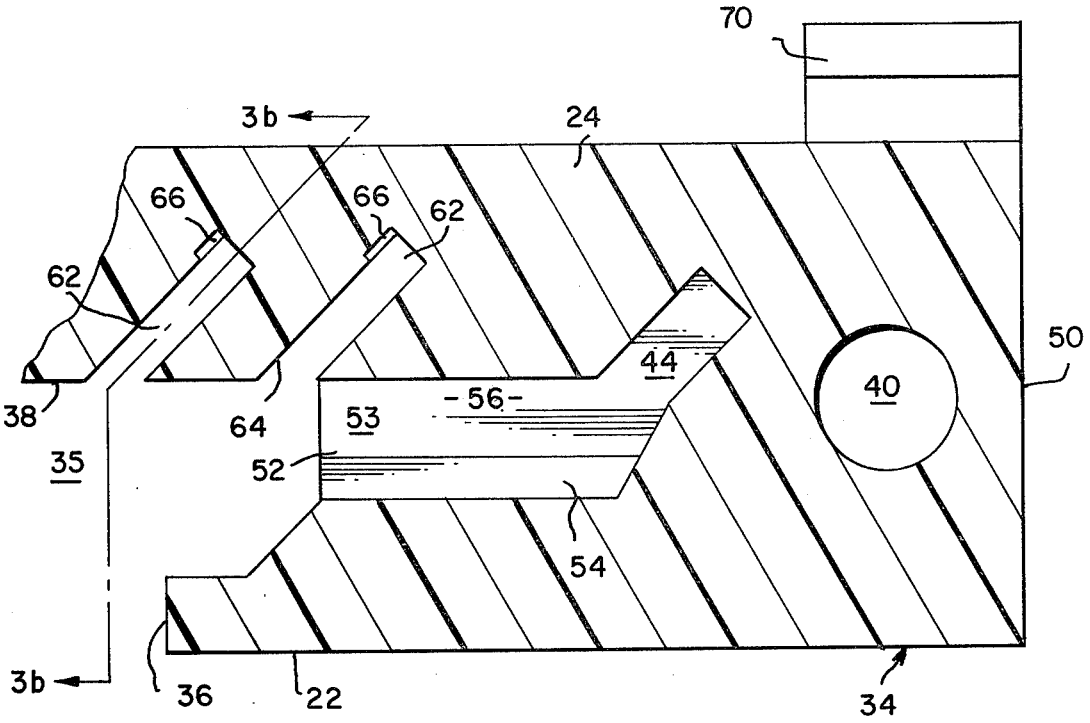
FIG. 3-*a* is a cross-sectional view looking down into a portion of a connector and FIG. 3-*b* is an elevational, cross-sectional view taken along line 3-*b*—3-*b* of FIG. 3-*a;*
Figure 3B:
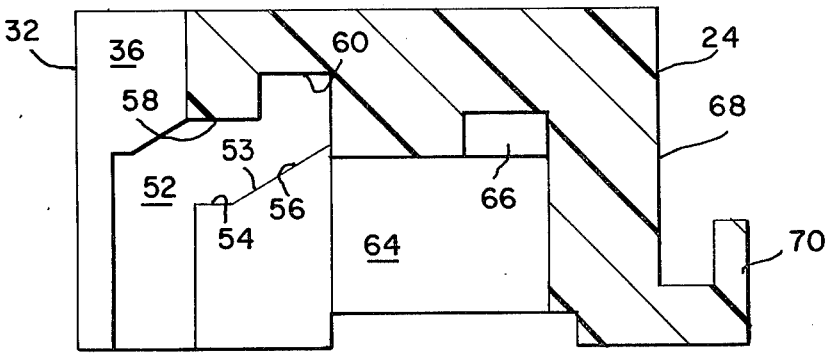

The internal structure of housing 24 may be seen in FIGS. 3-*a* and 3-*b*. FIG. 3-*a* is a sectional view of the housing taken from above. The view includes end 34 and a short portion of the recessed section. FIG. 3-*b*, an elevational view, is taken along line 3-*b*—3-*b* of FIG. 3-*a*. the view is looking into left end 32.

With the exception of the presence of slot 44, both ends, 32 and 34 of housing 24, are structurally the same. As noted before, each end has a thru-hole 40 located adjacent to end-wall 50 of the housing. Additionally each end contains a passageway 52 which opens out into recess 35. These passageways are parallel to the housing length and functionally are to slidingly receive the ends 48 of actuating bar 26. The floor 53 of the passageways has a horizontal front section 54 and a slanted rear section 56. FIG. 3-*b* shows these sections clearly. FIG. 3-*b* also shows the roof of the passageway. It is formed with two horizontal sections, 58 and 60, with one section vertically displaced relative to the other.

Returning to FIG. 3-*a*, the drawing shows passageway 52 merging into slot 44 in end 34.

Housing 24 contains a plurality of spaced apart cavities 62 extending along front wall 38 and opening out to recess 35. The cavities are also open to the under side of the housing. As viewed in FIG. 3-*a*, the left side wall 64 of each cavity has a niche 66. As seen in FIG. 3-*b*, the niches are located in the upper right hand corner of the side wall.

Back wall 68 of housing 24 has two, L-shaped members 70, one located at each end corner. These may be seen in FIG. 1 as are the two substrate support fingers 72. These fingers extend rearwardly from the lower edge of the back wall.

Figure 4:
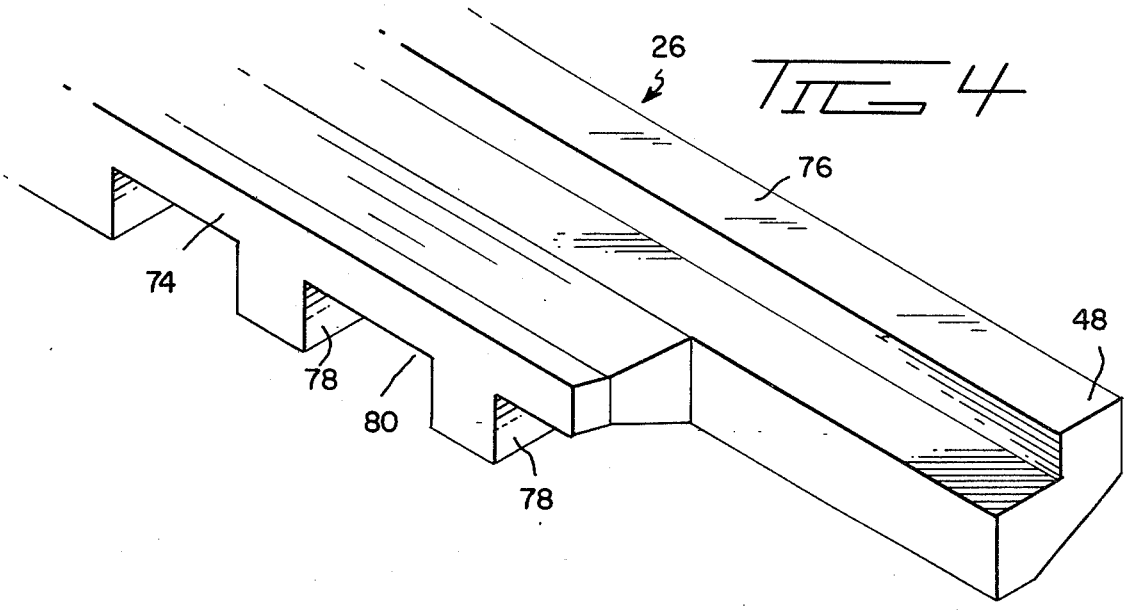
FIG. 4 is a view of the actuating bar used in the connector of the present invention.

FIG. 4 shows a portion of actuating bar 26 including one end 48. As the bar is symmetrical, the description following is applicable to the entire bar.

The bar has a front section 74 and back section 76. The front section has a number of depending bosses 78 which define slots 80 therebetween.

The back section has a shape compatable with the aforementioned passageway 52.

Bar 26 is preferably molded as one piece, a preferred material being polyester.

Figure 6:
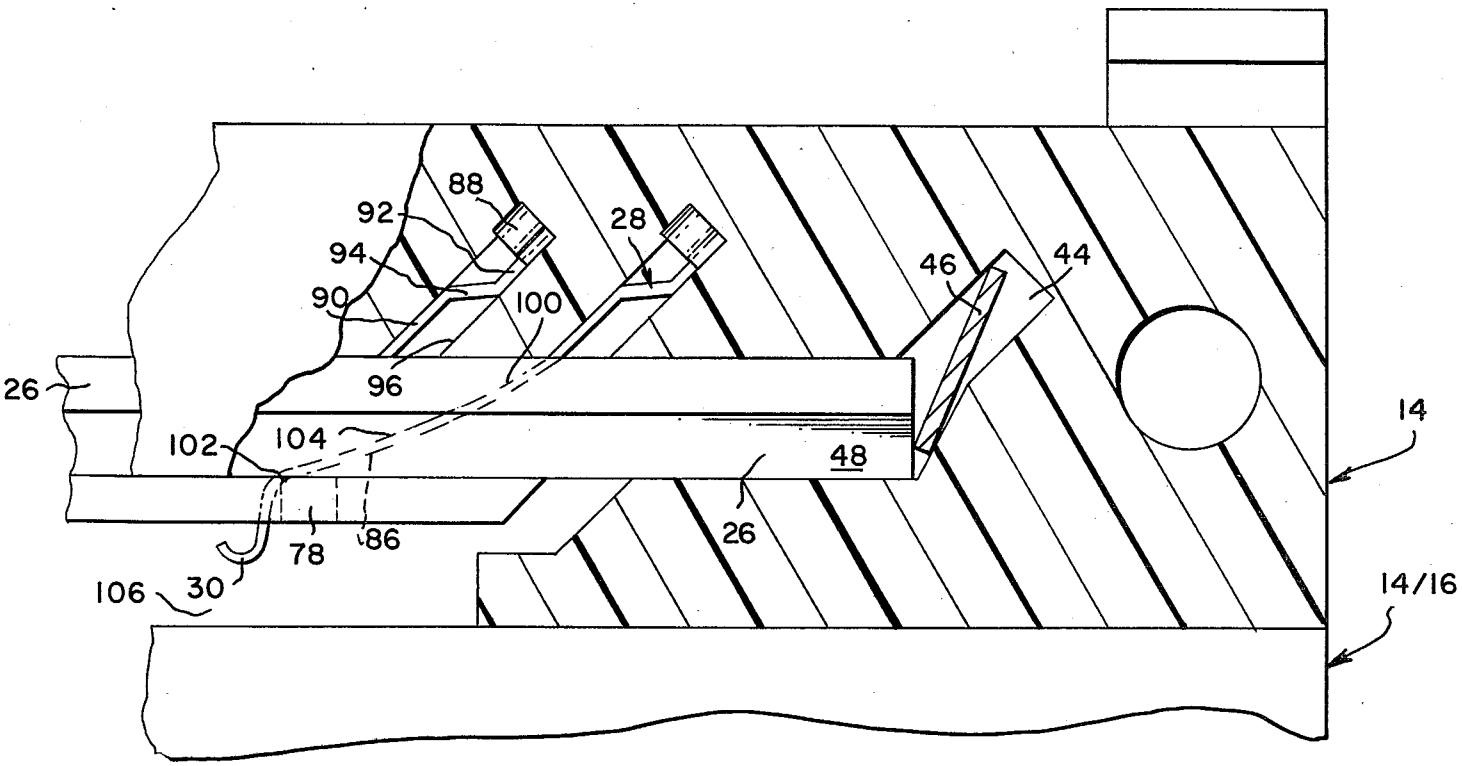
FIGS. 6, 7 and 8 illustrate the operation of the connector of the present invention.

A spring member 28 is shown in side elevation in FIG. 5. A top view of a spring member is shown in FIG. 6.

Each spring member has a sturdy body section 82, a depending pin or leg 84, cantilever beams 86 and a locking finger 88.

The body section 82 has a front portion 90, rear portion 92 and connecting portion 94. As seen in FIG. 6, the front and rear portions are displaced so that the front portion bears against side wall 64 and the rear portion bears against the opposite side walls 96. Locking finger 88 extends from the upper free corner of the rear portion into niche 66. As FIG. 5 shows, the finger is U-shaped with the free end facing downwardly.

Leg 84, which is attached to the connecting portion 94, is adapted to be inserted into a plated thru hole 98 in PCB 12.

Cantilever beam 86 extends forwardly from body section 82, being connected thereto by strap 100 whose top and bottom edges converge towards the narrow beam.

From strap 100 the beam extends straight forwardly to and then, near the free end, takes a sharp turn or bend to the right as viewed in FIG. 6. The bend is about eighty degrees relative to straight portion of the beam. The bend is indicated by reference numeral 102. Below bend 102, the beam terminates in the aforementioned contact end 30. As shown in FIG. 6, contact end 30 has been formed into an arcuate shape as viewed from above or a cylindrical shape as viewed from the front (FIG. 2). As noted above the beam includes a straight portion; however the drawing in FIG. 6 shows this portion, indicated by reference numeral 104, which includes strap 100, to be curved. The reason for this is that FIG. 6 is a view with the spring members loaded in the connector wherein the beams are pre-loaded.

Spring members 28 are preferably stamped and formed from a coplanar strip of conductive material such as beryllium copper.

Support plate 16 is an elongated housing having L-shaped members 70 and substrate support fingers 72 on its back face. It also has two mounting holes 40, one at each end. It has no other structural features.

To assemble a connector 14, ends 48 of the actuating bar 26 are placed into passageways 52 at either end of the housing. Being made of polyester, the bar can bend with difficulty to facilitate this assembly. The spring member is loaded into a cavity 62 from the under side of the housing. It is pushed up to where the free end of finger 88 pops into niche 66. The cantilever beam is simultaneously guided into a proper slot 80. As noted above, the beams are preloaded by the slots 80 being off-set relative to the cavities. Thus in connectors 14, the beams are pushing towards the right; i.e., housing end 34.

Connector system 10 is assembled by latching two or more connectors 14 together along with a plate 16. The connectors are latched together by the L-shaped members 70 fitting into the L-shaped notches 40. FIG. 1 shows the mating. The nature of the latching provides not a locked condition but a dimensional locating of adjacent connectors for proper placement of the substrates. The aforementioned screws 70 in conjunction with legs 84 being placed in PCB holes 98 does lock the system in.

Figure 7:
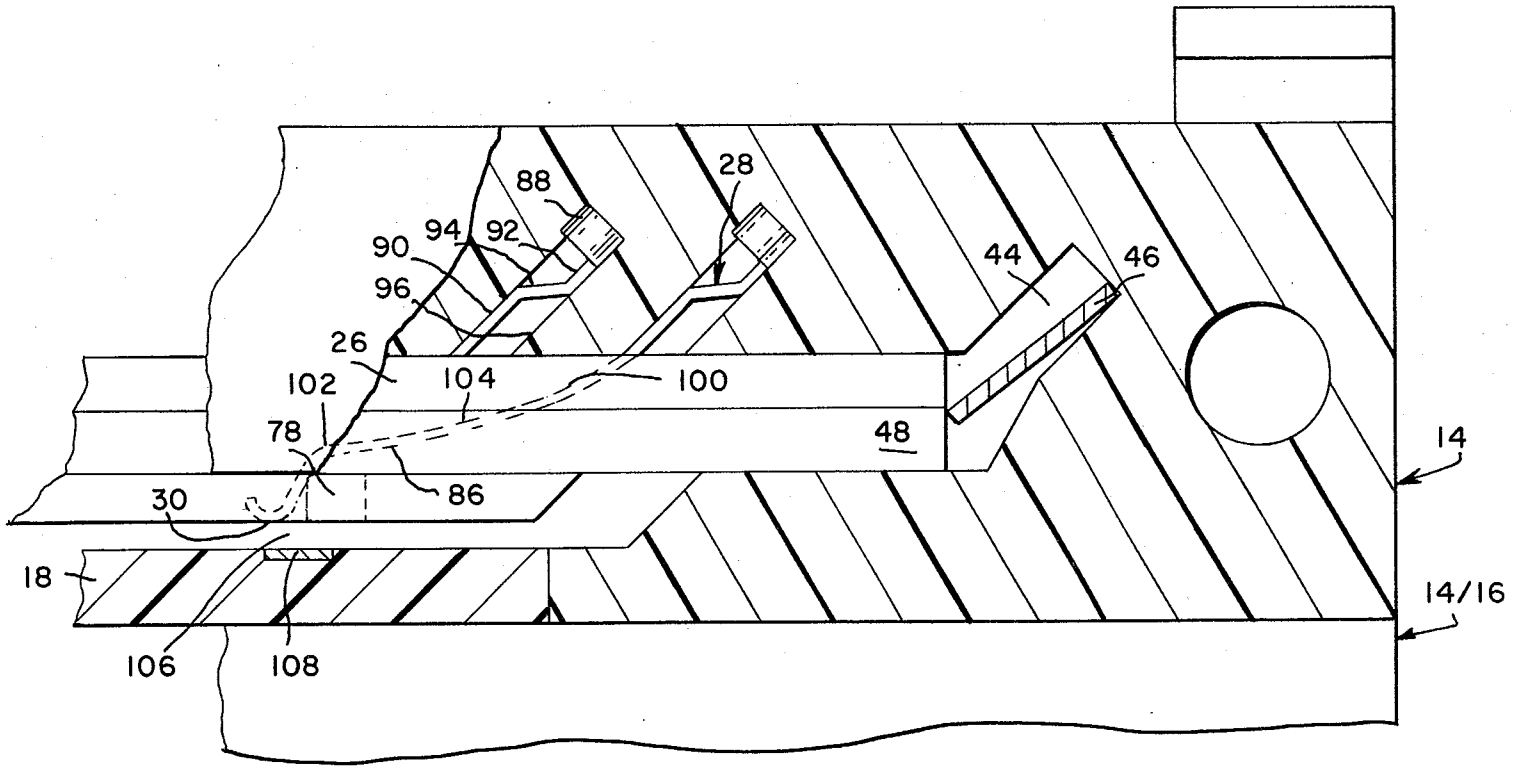
Figure 8:
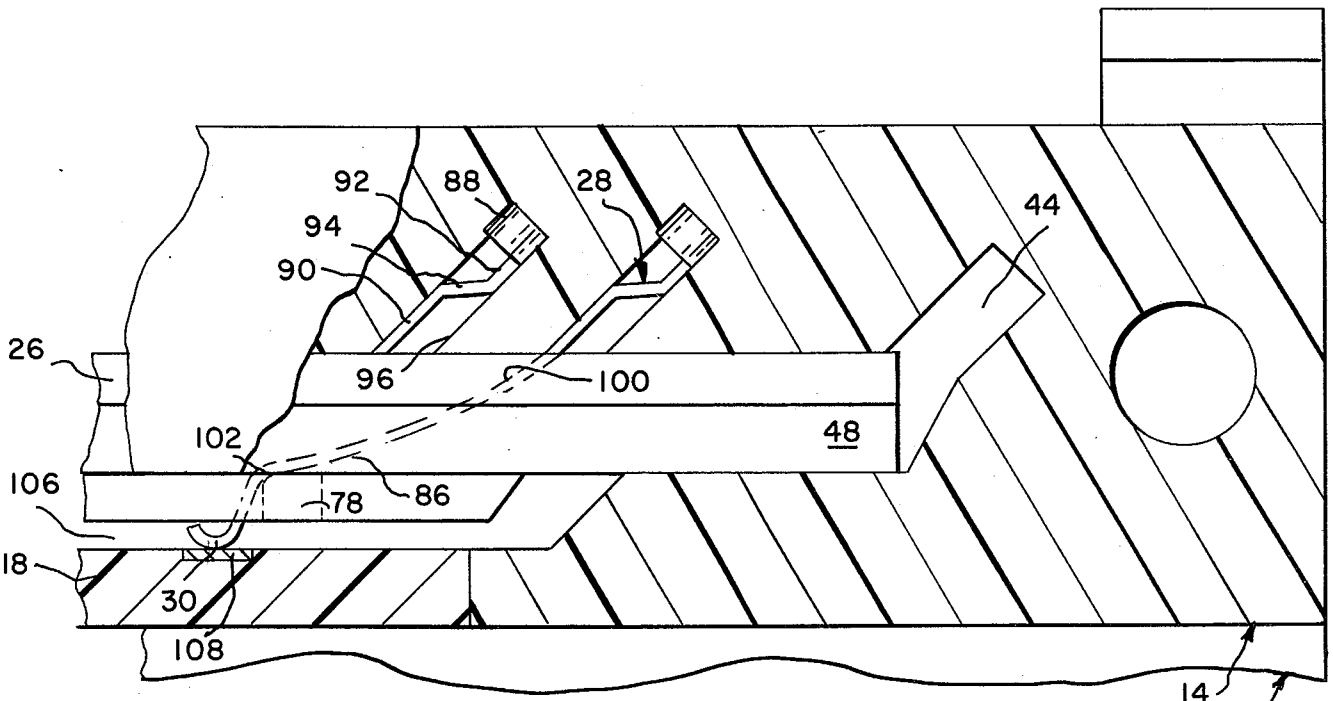

FIGS. 6, 7 and 8 illustrate the use of the system and individual connectors. In these drawings two connectors 14 or one connector 14 and one plate 16 are latched together. Recess 35 is thus transformed into pocket 106 with support fingers 72 of the front connector 14/plate 16 providing a floor.

In FIG. 6, tip 46 of a screwdriver is positioned in slot 44 with one side bearing against end 48 of bar 26.

In FIG. 7, the screwdriver tip 46 has been rotated, pushing actuating bar to the left; i.e., in the direction of the arrow. As the bar moves, bosses 78 (shown in phantom) catch the cantilever beams and cams them clockwise, thereby widening pocket 106. While the bar and beams are so positioned a substrate is inserted into the pocket.

FIG. 8 shows the substrate in place in the pocket. Upon withdrawing screwdriver tip 46 from slot 44, the actuating bar slides back to the right from the pressure of the cantilever beams and contact ends 30 contact traces 108 on the substrate. Obviously the dimensions of the several components of the connector must be tailored so that the contact ends 30 squarely engage the traces 108 on the substrate. The bosses 78 on the bar preferably should not be touching the cantilever beam with a substrate in place. This allows the full pressure of the pre-loaded beams to bear against the traces for enhanced electrical contact.

Figure 9:
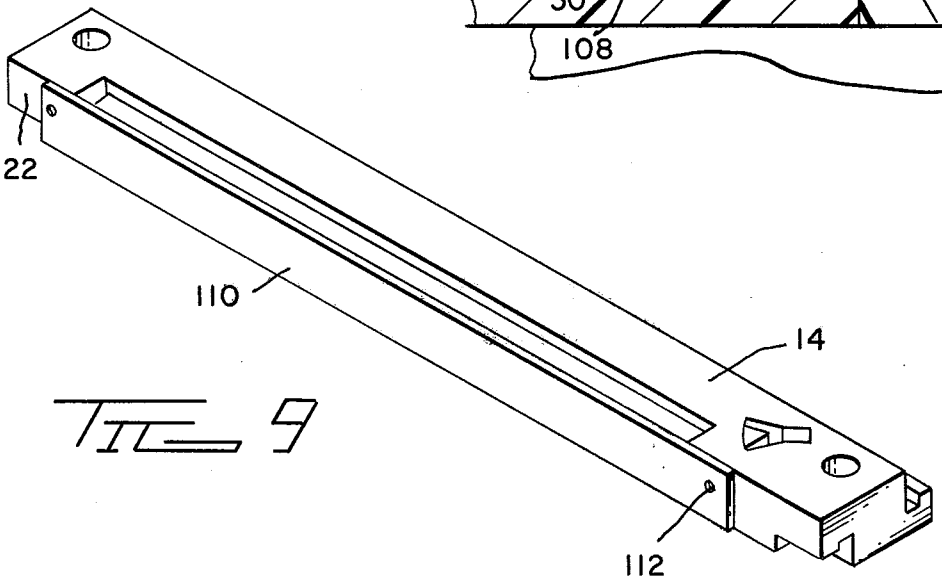
FIG. 9 shows a modification to the connector of the present invention.

FIG. 9 illustrates a modification to connector 14 which can be used in those cases where only one connector 14 is needed and a support plate 16 is either unavailable or unacceptable; e.g., lack of space on the PCB. A plate 110 having rearwardly extending support fingers (not shows) on its bottom edge, is secured to front face 22 of the connector by means of screws 112 or other conventional means. The plate, in cooperation with side walls 36, front wall 38 and recess 35 provides pocket 106 for receipt of a substrate.

Another modification may be made to housing 24 which would simplify the molding thereof. The modification involves eliminating floor 53 of passageway 52 and niches 66 in cavities 62. Actuating bar 26 would be supported by the upper edges of cantilever beams 86. Retention of spring members 28 would depend on an interference fit between the cavity wall and U-shaped locking fingers 88. The free ends thereof would also act as a barb, digging into the wall.

It is to be understood that the forms of the invention shown and described herein are but preferred embodiments thereof and that various changes and modifications can be made therein without departing from the spirit or scope of the invention.

What is claimed is:

1. A connector for electrically connecting the circuits on one side of a substrate to the circuits on a printed circuit board, comprising:

a. an elongated housing having a recess in and along one side for receiving an edge of a substrate, and further having a plurality of spaced-apart cavities opening out into a front wall of the recess and extending back into the housing at an angle oblique to the longitudinal axis thereof and with the oblique direction being towards a first end of the recess, and further having support means at each end of the recess for supporting an actuating bar;

b. a plurality of spring members each having a body section with a leg depending from a lower edge and an elongated, resilient cantilever beam extending away from a lateral edge with the free end of the beam having a contact surface thereon, said body further having means thereon for securing the spring member in one of said cavities with the leg depending from the housing for insertion into a printed circuit board and with the cantilever beam extending out into the recess at substantially said oblique angle so that the contact surface thereon may engage a substrate which may be positioned therein; and c. an elongated actuating bar having bosses spaced along one surface and slidably positioned in the recess adjacent the face thereof with the ends of the bar received by said support means and with the bosses extending downwardly between the cantilever beams so that as the bar is moved parallel to the housing axis and towards the first end of the recess, the bosses bear against and resiliently bend the beams in towards the front wall of the recess and out of engagement with the substrate which may be positioned therein.

2. The connector of claim 1 wherein the cantilever beams are laterally bent at a short distance behind the contact surfaces so as to provide an abutting location for the bosses.

3. The connector of claim 2 wherein the degre of bending is about eighty degrees relative to the longitudinal axis of the beams.

* * * * *